US007422495B2

(12) United States Patent
Kinoshita et al.

(10) Patent No.: US 7,422,495 B2
(45) Date of Patent: Sep. 9, 2008

(54) OPERATION CONTROL SYSTEM FOR SMALL BOAT

(75) Inventors: Yoshimasa Kinoshita, Shizuoka-ken (JP); Sumihiro Takashima, Shizuoka-ken (JP); Shu Akuzawa, Shizuoka-ken (JP); Kazumasa Ito, Shizuoka-ken (JP); Toshiyuki Hattori, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 77 days.

(21) Appl. No.: 11/335,996

(22) Filed: Jan. 20, 2006

(65) Prior Publication Data

US 2006/0160437 A1 Jul. 20, 2006

(30) Foreign Application Priority Data

Jan. 20, 2005 (JP) ..... 2005-012848

(51) Int. Cl.
*B63H 21/22* (2006.01)
*B63H 21/10* (2006.01)

(52) U.S. Cl. ..... 440/1; 440/3

(58) Field of Classification Search ..... 440/1–3, 440/10

See application file for complete search history.

(56) References Cited

U.S. PATENT DOCUMENTS

| | | | |
|---|---|---|---|
| 3,183,879 | A | 5/1965 | Heidner |
| 4,423,630 | A | 1/1984 | Morrison |
| 4,445,473 | A | 5/1984 | Matsumoto |
| 4,492,195 | A | 1/1985 | Takahashi et al. |
| 4,556,005 | A | 12/1985 | Jackson |
| 4,767,363 | A | 8/1988 | Uchida et al. |
| 4,949,662 | A | 8/1990 | Kobayashi |
| 4,961,396 | A | 10/1990 | Sasagawa |
| 4,971,584 | A | 11/1990 | Inoue et al. |
| 4,972,792 | A | 11/1990 | Yokoyama et al. |
| 4,989,533 | A | 2/1991 | Horuichi |

(Continued)

FOREIGN PATENT DOCUMENTS

| | | |
|---|---|---|
| CA | 2271332 | 2/2000 |

(Continued)

OTHER PUBLICATIONS

Advertisement for trim adjuster for Sea-Doo watercraft—Personal Watercraft Illustrated, Aug. 1998.

(Continued)

*Primary Examiner*—Jesés D. Sotelo
*Assistant Examiner*—Daniel V. Venne
(74) *Attorney, Agent, or Firm*—Knobbe, Martens, Olson & Bear, LLP

(57) ABSTRACT

An operation control system for a small boat can include a mode selection module configured to allow a driver to select between a plurality of driving modes including at least a normal operation mode, in which the boat cruises at a speed in response to the displacement of an acceleration controller, and a low-speed setting mode, in which the boat cruises at a preset low speed when a low-speed setting controller is operated; in which the mode selection module permits the driving mode to switch to the low-speed setting mode if the displacement of the acceleration controller is zero, or small or close to zero or is in or substantially at an idle position.

14 Claims, 7 Drawing Sheets

U.S. PATENT DOCUMENTS 5,094,182 A 3/1992 Simner
5,113,777 A 5/1992 Kobayashi
5,118,315 A 6/1992 Funami et al.
5,144,300 A 9/1992 Kanno
5,167,546 A 12/1992 Whipple
5,167,547 A 12/1992 Kobayashi et al.
5,169,348 A 12/1992 Ogiwara et al.
5,184,589 A 2/1993 Nonaka
5,199,261 A 4/1993 Baker
5,203,727 A 4/1993 Fukui
5,244,425 A 9/1993 Tasaki et al.
5,350,325 A 9/1994 Nanami
5,352,138 A 10/1994 Kanno
5,366,394 A 11/1994 Kanno
5,367,970 A 11/1994 Beauchamp et al.
5,408,948 A 4/1995 Arii et al.
5,429,533 A 7/1995 Kobayashi et al.
5,474,007 A 12/1995 Kobayashi
5,520,133 A 5/1996 Wiegert
5,538,449 A 7/1996 Richard
5,591,057 A 1/1997 Dai et al.
5,603,644 A 2/1997 Kobayashi et al.
5,665,025 A 9/1997 Katoh
5,687,694 A 11/1997 Kanno
5,697,317 A 12/1997 Pereira
5,707,264 A 1/1998 Kobayashi et al.
5,713,297 A 2/1998 Tani et al.
5,805,054 A 9/1998 Baxter
5,826,557 A * 10/1998 Motoyama et al. ..... 123/198 F
5,839,700 A 11/1998 Nedderman, Jr.
5,904,604 A 5/1999 Suzuki et al.
5,908,006 A 6/1999 Ibata
5,941,188 A 8/1999 Takashima
5,988,091 A 11/1999 Willis
6,032,605 A 3/2000 Takashima
6,032,653 A 3/2000 Anamoto
6,038,995 A 3/2000 Karafiath et al.
6,062,154 A 5/2000 Ito
6,086,437 A 7/2000 Murray
6,102,755 A 8/2000 Hoshiba
6,116,971 A 9/2000 Morikami
6,135,095 A 10/2000 Motose et al.
6,138,601 A 10/2000 Anderson et al.
6,148,777 A 11/2000 Motose et al.
6,159,059 A 12/2000 Bernier et al.
6,168,485 B1 1/2001 Hall et al.
6,171,159 B1 1/2001 Shen et al.
6,174,210 B1 1/2001 Spade et al.
6,178,907 B1 1/2001 Shirah et al.
6,202,584 B1 3/2001 Madachi et al.
6,213,044 B1 4/2001 Rodgers et al.
6,216,624 B1 4/2001 Page
6,227,919 B1 5/2001 Blanchard
6,244,914 B1 6/2001 Freitag et al.
6,273,771 B1 8/2001 Buckley et al.
6,305,307 B1 10/2001 Yokoya
6,314,900 B1 11/2001 Samuelsen
6,332,816 B1 12/2001 Tsuchiya et al.
6,336,833 B1 1/2002 Rheault et al.
6,336,834 B1 1/2002 Nedderman, Jr. et al.
6,386,930 B2 5/2002 Moffet
6,390,862 B1 5/2002 Eichinger
6,405,669 B2 6/2002 Rheault et al.
6,415,729 B1 7/2002 Nedderman, Jr. et al.
6,428,371 B1 8/2002 Michel et al.
6,428,372 B1 8/2002 Belt
6,443,785 B1 9/2002 Swartz et al.
6,478,638 B2 11/2002 Matsuda et al.
6,508,680 B2 1/2003 Kanno
6,511,354 B1 1/2003 Gonring et al.
6,523,489 B2 2/2003 Simzrd et al.
6,530,812 B2 3/2003 Koyano et al.
6,551,152 B2 4/2003 Matsuda et al.
6,565,397 B2 5/2003 Nagafusa
6,568,968 B2 5/2003 Matsuda et al.
6,668,796 B2 12/2003 Umemoto et al.
6,695,657 B2 2/2004 Hattori
6,709,302 B2 3/2004 Yanagihara
6,709,303 B2 3/2004 Umemoto et al.
6,722,302 B2 4/2004 Matsuda et al.
6,722,932 B2 4/2004 Yanagihara
6,732,707 B2 5/2004 Kidokoro et al.
6,733,350 B2 5/2004 Iida et al.
6,776,676 B2 8/2004 Tanaka et al.
6,783,408 B2 8/2004 Uraki et al.
6,805,094 B2 10/2004 Hashimoto et al.
6,827,031 B2 12/2004 Aoyama
6,855,014 B2 2/2005 Kinoshita et al.
6,863,580 B2 3/2005 Okuyama
6,884,128 B2 4/2005 Okuyama et al.
6,886,529 B2 5/2005 Suzuki et al.
6,990,953 B2 1/2006 Nakahara et al.
6,997,763 B2 2/2006 Kaji
7,037,147 B2 5/2006 Kinoshita et al.
7,077,713 B2 7/2006 Watabe et al.
7,089,910 B2 8/2006 Kanno et al.
7,168,995 B2 1/2007 Masui et al.
7,175,490 B2 * 2/2007 Kanno et al. ..... 440/2
7,207,856 B2 4/2007 Ishida et al.
2002/0049013 A1 4/2002 Kanno
2003/0000500 A1 1/2003 Chatfield
2003/0089166 A1 5/2003 Mizuno et al.
2004/0067700 A1 4/2004 Kinoshita et al.
2004/0069271 A1 4/2004 Kanno et al.
2004/0147179 A1 7/2004 Mizuno et al.
2005/0009419 A1 1/2005 Kinoshita
2005/0085141 A1 4/2005 Motose
2005/0263132 A1 12/2005 Yanagihara
2005/0273224 A1 12/2005 Ito et al.
2005/0287886 A1 12/2005 Ito et al.
2006/0004502 A1 1/2006 Keneko et al.
2006/0037522 A1 2/2006 Keneko et al.
2006/0081215 A1 4/2006 Kinoshita
2006/0157026 A1 7/2006 Ishida et al.
2006/0160438 A1 7/2006 Kinoshita et al.
2006/0160440 A1 7/2006 Ishida et al.
2007/0021015 A1 1/2007 Kinoshita et al.

FOREIGN PATENT DOCUMENTS

JP 06-137248 5/1994
JP 7-40476 9/1995
JP 2001-152895 6/2001
JP 2001-329881 11/2001
JP 2002-180861 6/2002
JP 2004-092640 3/2004
JP 2004-137920 5/2004
WO WO 00/40462 7/2000

OTHER PUBLICATIONS

Advertisement for trim adjuster—Jet Sports, Aug. 1997.
Advertisement for Fit and Trim and Fit and Trim II—Jet Sports. Aug. 1996.

* cited by examiner

OPERATION CONTROL SYSTEM FOR SMALL BOAT

PRIORITY INFORMATION

The present application is based on and claims priority under 35 U.S.C. § 119(a-d) to Japanese Patent Application No. 2005-012848, filed on Jan. 20, 2005 the entire contents of which is expressly incorporated by reference herein.

BACKGROUND OF THE INVENTIONS

1. Field of the Inventions

These inventions relate to a planning-type watercraft, and more particularly to improvements in operation control systems for such watercraft.

2. Description of the Related Art

When driving a watercraft into or out of a marina, operators must drive at speeds lower than about five miles per hour. These areas are all often referred to as "No Wake Zones." Operating a boat at such a low speed can be tiresome.

For example, watercraft that include throttle levers that are biased toward a closed position, such as those used on personal watercraft and some jet boats, require the operators to hold the throttle lever with their fingers or foot in a position so as to hold the throttle lever at a precise location so that the watercraft will move only at a slow speed. Thus, more recently, some small watercraft have been provided with cruise control systems that facilitate smooth acceleration for cruising in a speed-limited area as well as for longer cruising uses.

For example, Japanese Patent Document JP-A-2002-180861 discloses a cruise control system for a planning-type watercraft in which, with a throttle valve opened to a driver-determined position, the driver can turn-on a cruise control operation switch to control the degree of throttle opening such that the then current engine speed is maintained.

SUMMARY OF THE INVENTIONS

An aspect of at least one of the embodiments disclosed herein includes the realization that if a driver of such a boat switches driving modes between a normal mode and another mode, such as a low-speed mode, the boat might decelerate quickly, resulting in reduced rider comfort.

Thus, in accordance with an embodiment, an operation control system for a small boat can be provided. The system can comprise acceleration displacement detecting means for detecting the displacement of an acceleration controller, and mode selection means for selecting a driving mode from a normal operation mode in which the boat cruises at a speed in response to the displacement of the acceleration controller detected by the acceleration displacement detecting means, and a low-speed setting mode in which the boat cruises at a preset low speed when a low-speed setting controller is operated. The mode selection means can permit the driving mode to switch to the low-speed setting mode if the displacement of the acceleration controller is zero, or small or close to zero.

In accordance with another embodiment, an operation control system for a small boat can be provided. The boat can include an acceleration input device configured to allow a driver of the small boat to input an acceleration input. The system can comprise an acceleration displacement detector configured to detect a displacement of an acceleration controller, and a mode selection module configured to allow a driver of the small boat to select between a plurality of driving modes. The driving modes can include at least a normal operation mode in which the boat cruises at a speed in response to the displacement of the acceleration input device detected by the acceleration displacement detecting module, and a low-speed setting mode in which the boat cruises at a preset low speed when a low-speed setting controller is operated. The mode selection module can be configured to permit the driving mode to switch to the low-speed setting mode if the displacement of the acceleration input device is in or substantially at an idle speed position.

DETAILED DESCRIPTION OF THE PREFERRED EMBODIMENT

Figure 1:
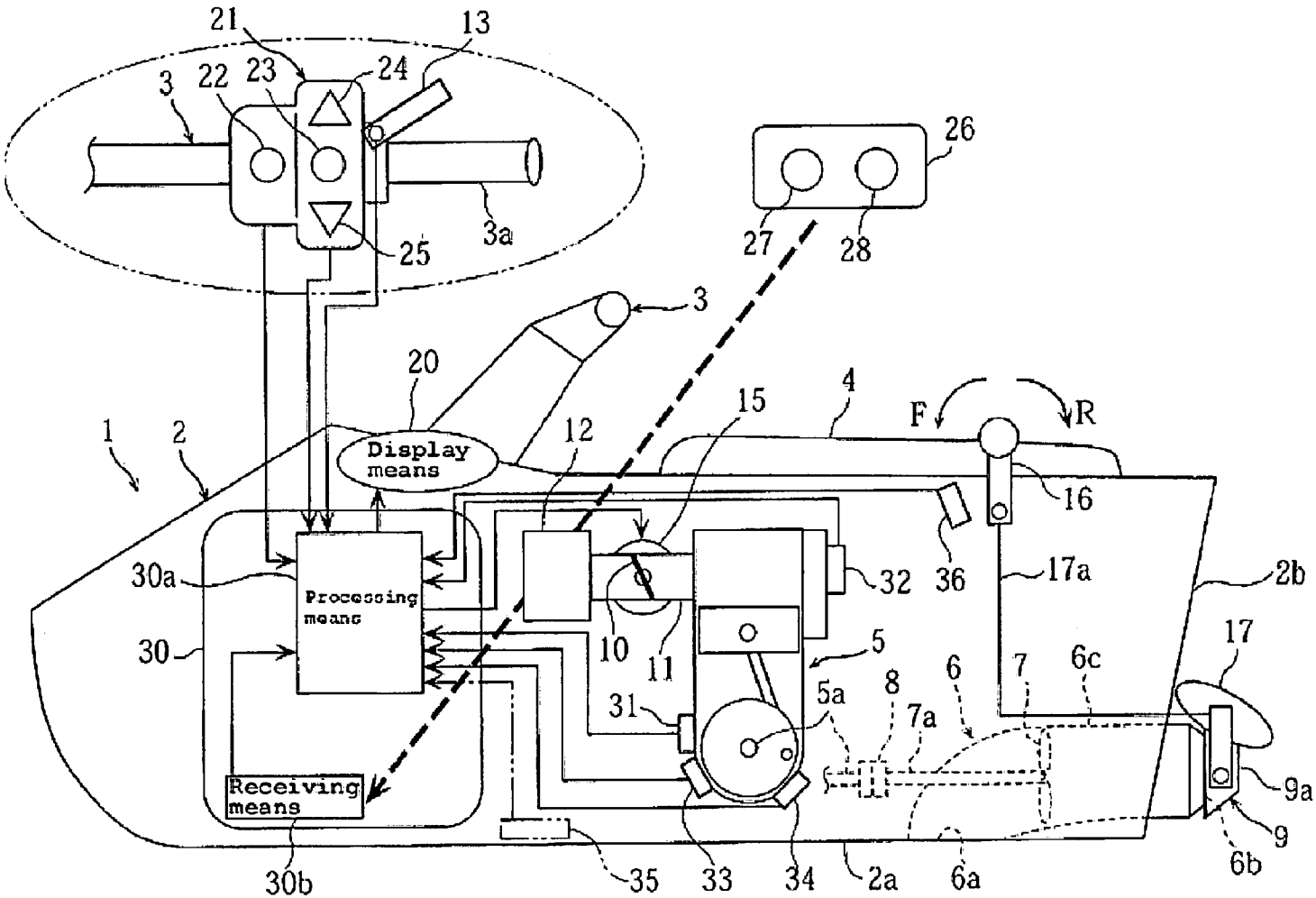
FIG. 1 is a schematic diagram of a planning-type boat having an operation control system according to an embodiment.
Figure 2:
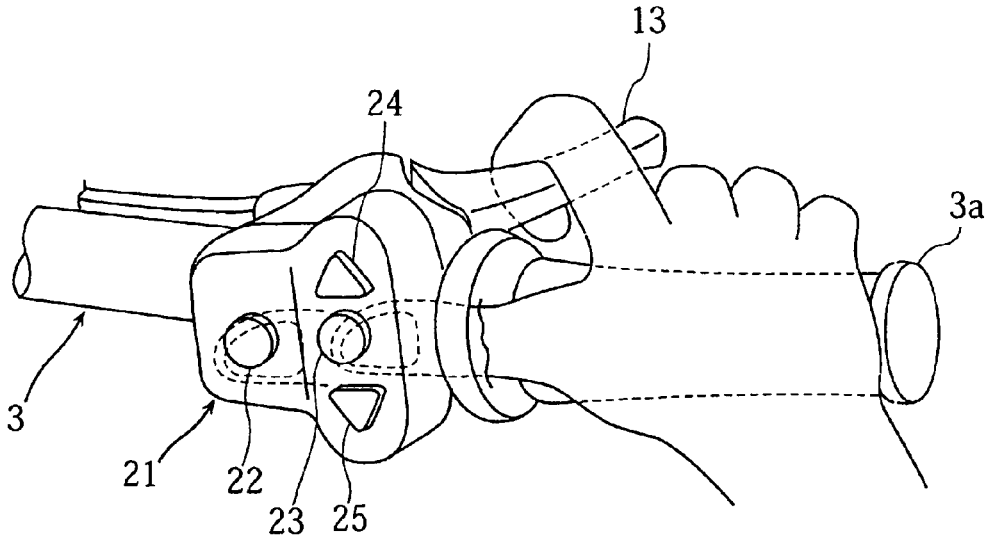
FIG. 2 is a perspective view of a steering handlebar of the planing boat.

The planing boat 1 can include a box-shaped, generally watertight hull 2, a steering handlebar 3 located at the forward upper surface of the hull, a straddle type seat 4 located at the rearward upper surface of the hull, an engine 5 and a propulsion unit 6 both accommodated in the bull 2. However, other configurations can also be used. The operation control system and methods described herein are disclosed in the context of a personal watercraft because they have particular utility in this context. However, the operation control system and methods described herein can also be used in other vehicles, including small jet boats, as well as other watercraft and land vehicles.

The propulsion unit 6 can include an inlet port 6*a* having an opening at a bottom 2*a* of the hull 2, an outlet port 6*b* having an opening at a stern 2*b*, and a propulsion passage 6*c*. The inlet and outlet ports can communicate through the propulsion passage.

An impeller 7 can be disposed within the propulsion passage 6*c*. An impeller shaft 7*a* of the impeller 7 can be coupled to a crankshaft 5*a* of the engine 5 through a coupling 8. The impeller shaft 7 can be comprised of one or plurality of shafts connected together. The engine 5 can thus drive the impeller 7 so as to rotate. This pressurizes the water drawn from the inlet port 6*a* and emits a jet of the pressurized water rearward from the outlet port 6*b*, thereby producing thrust.

To the outlet port 6*b*, a jet nozzle 9 can be connected for swinging movement to the left or right. The handlebar 3 can be connected to the jet nozzle 9 with any known connection device. Thus, steering the steering handlebar 3 to the left or right allows the jet nozzle 9 to swing left or right, thereby turning the hull 2 left or right.

The engine 5 can be mounted with its crankshaft 5*a* oriented in the front-to-rear direction of the hull, however, other configurations or orientations can also be used.

A throttle body 11 incorporating a throttle valve 10 can be connected to the engine 5. A silencer 12 can be connected to the upstream end of the throttle body 11.

An acceleration lever (controller) 13 can be disposed at a grip portion 3*a* of the steering handlebar 3 and can be operated, by a driver of the planing-type boat, to open/close the throttle valve 10. An actuator 15 can be connected to the throttle valve 10 to open/close the throttle valve 10. A control unit 30, described in greater detail below, drives and controls the actuator 15.

A forward/reverse drive shift lever 16 (which can function as a forward/reverse drive shifting means) can be disposed in the vicinity of the seat provided on the hull 2. The forward/reverse drive shift lever 16 can be linked to a reverse bucket 17 disposed on the jet nozzle 9 via an operation cable 17*a*.

When the forward/reverse drive shift lever 16 is rotated to a forward-drive position F, the reverse bucket 17 can be moved to allow a jet port 9*a* of the jet nozzle 9 to be opened. Water jet can be directed rearward so that the hull 2 moves forwardly. When the forward/reverse drive shift lever 16 is rotated to a reverse-drive position R, the reverse bucket 17 can be positioned to the rear of the jet port 9*a*. Water jet flow hits the reverse bucket 17 and is thus redirected toward the front of the hull 2, thereby moving the hull 2 in a reverse direction.

The steering handlebar 3 on the hull 2 can be provided with an operation box 21. In front of the steering handlebar 3, a display device 20 can also be provided. Reference numeral 26 denotes a remote control switch. The remote control switch 26 may be disposed on the hull.

The display device 20 can include a speedometer, a fuel gauge, and various display lamps (not shown). However, other gauges and displays can also be used. When any one of a low-speed setting mode, a speed-limiting mode and a speed-fixing mode is selected with, for example, the operation box 21, the display device lights a display lamp that responds to the selected mode.

The operation box 21 can be located inner side of the grip portion 3*a* of the steering handlebar 3 in the vehicle width direction. The operation box 21 can be provided with a low-speed setting switch 22, a speed-fixing switch 23, and acceleration/deceleration fine adjustment switches 24, 25. All the switches 22 to 25 can be disposed in an area where the driver's thumb can reach for operating these switches while the driver grabs the grip portion 3*a*. However, other configurations and arrangements can also be used. The remote control switch 26 can be provided with a speed-limiting switch 27 and a speed-limiting cancellation switch 28.

The planing boat 1 can have a control unit 30 for controlling all operations of the boat 1 including the engine. The control unit 30 can be configured to receive input values detected by various sensors including an engine speed sensor 31, a throttle opening sensor (not shown), an engine coolant temperature sensor 32, a lubricant temperature sensor 33, a lubricant pressure sensor 34, a cruising speed sensor 35 and a forward/reverse drive shift position sensor 36. However, other sensors can also be used.

Figure 3:
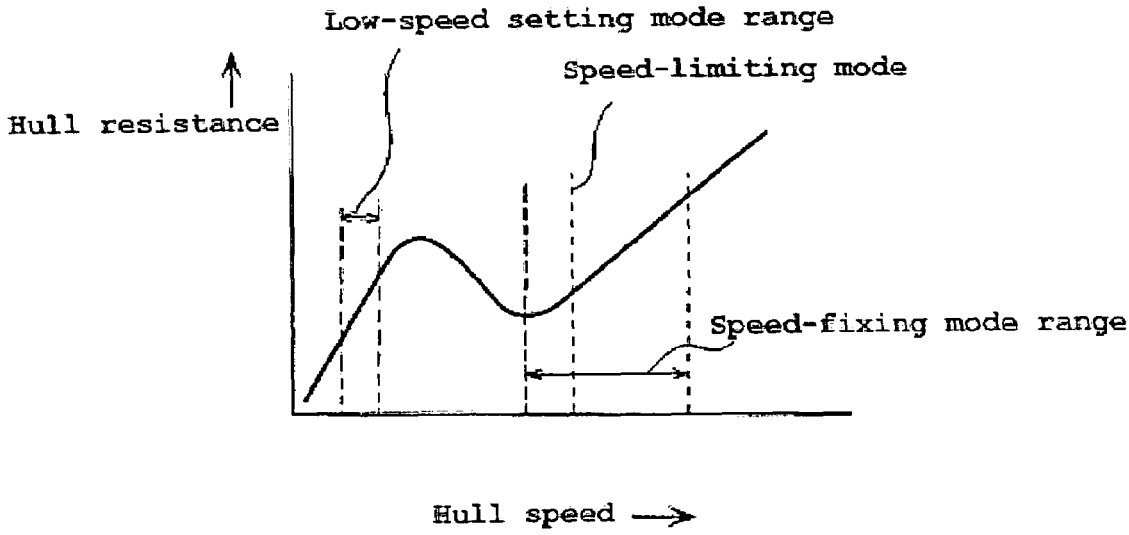
FIG. 3 is an exemplary map showing examples of ranges of speeds and modes in which the boat operates.

The control unit 30 can include processing means (CPU) 30*a* for driving and controlling the actuator 15 and the like. The processing means 30*a* can be configured to receive operation signals input from the low-speed setting switch 22, the speed-fixing switch 23, and the acceleration/deceleration fine adjustment switches 24, 25, and/or other switches or input devices. The processing means 30*a* can also be configured to receive operation signals input from the speed-limiting switch 27 and the speed-limiting cancellation switch 28 through receiving means 30*b*, and/or other switches or input devices. The control unit 30 can be configured to select among the cruising modes based on the operation signals from the switches (See FIG. 3).

For example, when in the normal operation mode, in which the boat cruises at a speed in response to the displacement of the acceleration lever 13 by the driver, the speed-fixing switch 23 can be depressed for a certain time period. Then, in response, the control unit 30 changes the driving mode to the speed-fixing mode, that is automatic cruising mode, and controls the throttle opening such that the cruising speed reaches a speed detected when the speed-fixing switch 23 is depressed. The speed-fixing mode is applicable to cruising at driver's desirable speed from low to high speed range under the planing state, or at a speed which improves fuel efficiency.

While the normal operation mode is selected, if the speed-limiting switch 27 is kept pressed for a certain time period, then the control unit 30 can change the driving mode to the speed-limiting mode and can control the throttle opening such that the engine speed does not exceed a predetermined value. The speed-limiting mode is applicable to cruising in a speed limited area or long-time or longer-distance touring.

Additionally, while the normal operation mode is selected, if the low-speed setting switch 22 is depressed for a certain time period, then the control unit 30 can select the low-speed setting mode and can control the throttle opening to achieve a predetermined low speed (such as, for example, but without limitation, 8 km/h). The low-speed setting mode is applicable to cruising in a speed-limited or speed-reduced area, such as shallow water, boat mooring sites, and/or no wake zones.

The control unit 30 can use an acceleration lever displacement sensor (not shown) to read the displacement of the acceleration lever 13. If the displacement is zero or a small value close to zero under which the acceleration lever 13 is almost at the fully closed position, the control unit 30 is designed to permit the driving mode to switch to the low-speed setting mode. If the displacement is greater than the aforementioned small value, the control unit 30 is designed to prohibit the driving mode from switching to the low-speed setting mode.

Figure 4:
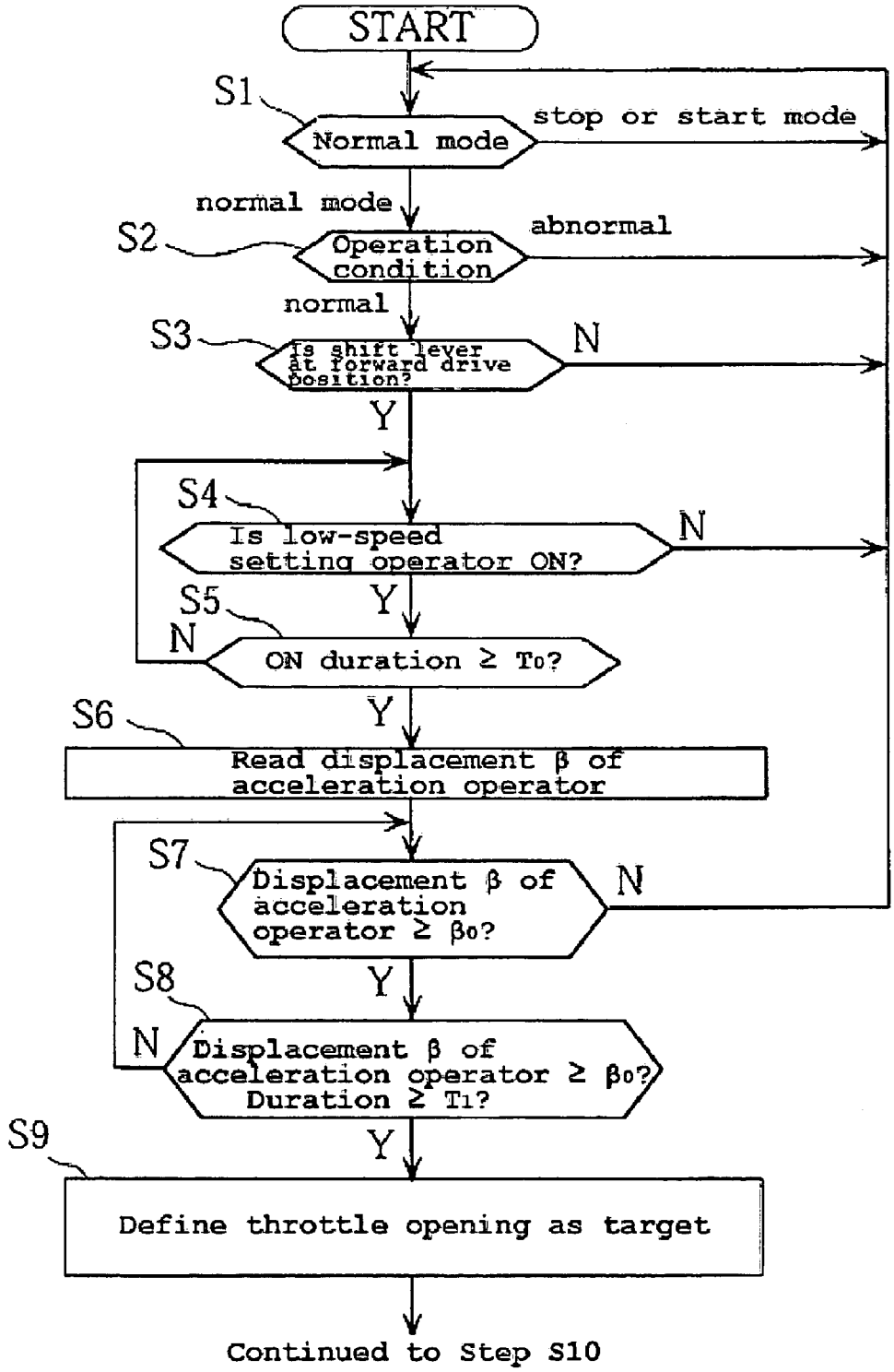
FIG. 4 is a flowchart of a control operation that can be used with the operation control system.
Figure 5:
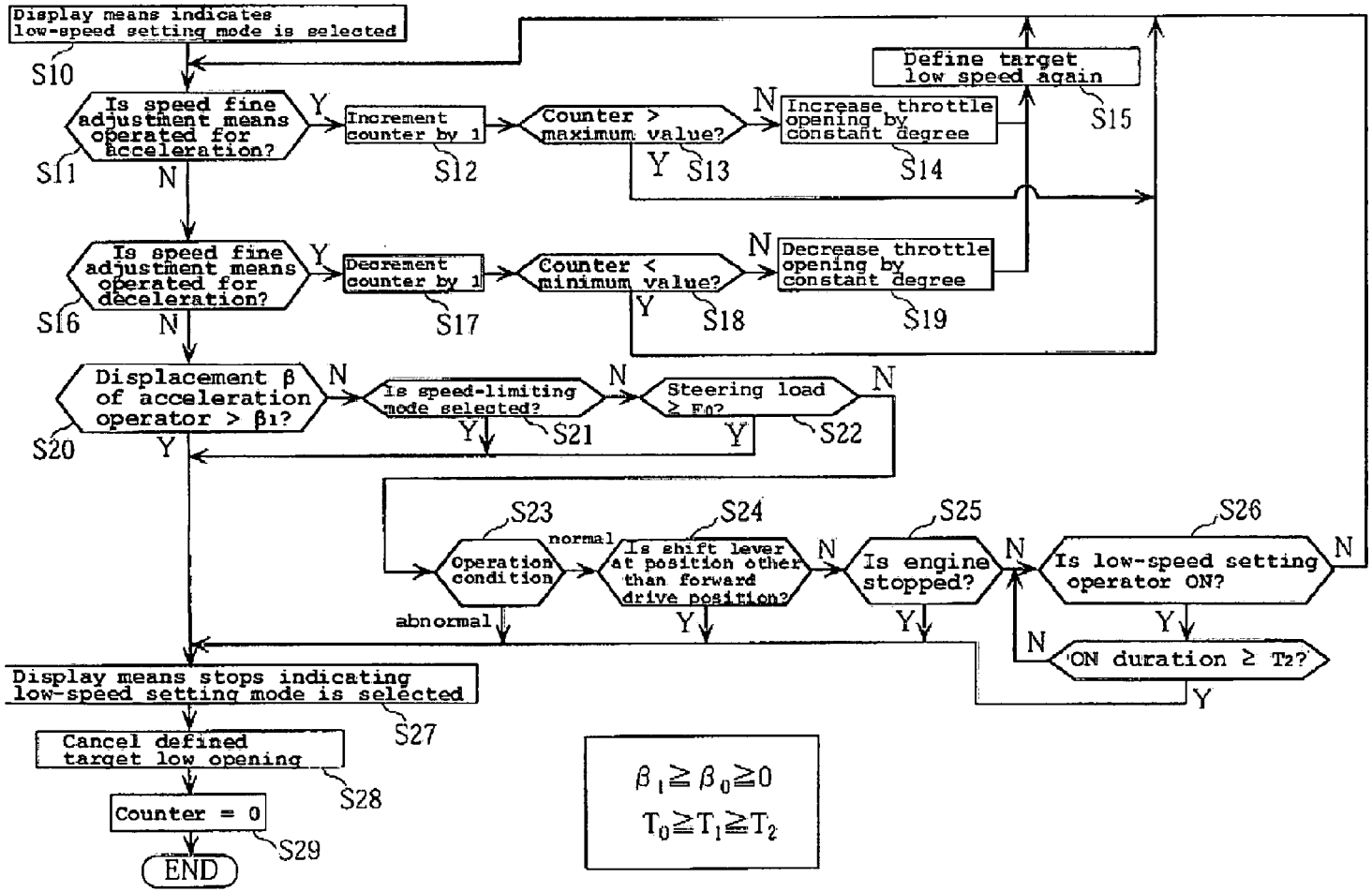
FIG. 5 is a continuation of the flowchart of FIG. 4.

A control operation that can be used by the control unit 30 is described in detail with reference to the flowcharts in FIGS. 4 and 5.

When a main switch is turned ON to start the engine, a determination is made whether or not the normal operation mode has been selected. If it is determined that the normal operation mode has been selected, another determination is made whether or not the engine operates and each sensor functions normally.

If all are determined to be under normal conditions, a further determination is made whether or not the forward/reverse drive shift lever is at the forward drive position (steps S1 to S3). If the forward/reverse drive shift lever is at the forward drive position, a further determination is made whether or not the low-speed setting switch 22 is turned ON (step S4).

If the normal operation mode has not been selected in the step S1, or the engine fails to operate normally or each sensor fails to function normally in the step S2, or the forward/reverse drive shift lever is at the reverse drive position in the step S3, the process flow goes back to the step S1 to repeat the process.

The engine is determined not to operate normally, if at least one of the lubricant temperature, coolant temperature and lubricant pressure exceeds its preset value. However, other parameters or analyses can be used to determine if the engine is operating normally.

In the step S4, if the low-speed setting switch 22 is turned ON, and the duration that the switch 22 is kept ON is equal to or longer than a predetermined time period $T_0$, then the displacement β of the acceleration lever 13 is read (steps S5 and S6). If the duration that the switch is kept ON is shorter than $T_0$ in the step S5, the process flow goes back to the step S4.

In the step S6, a determination is made whether or not the displacement β of the acceleration lever is equal to or lower than a preset value $\beta_0$, in other words, whether or not the acceleration lever 13 has almost or substantially returned to its fully closed position. If the displacement β is equal to or smaller than the preset value $\beta_0$ and the acceleration lever 13 is almost at the fully closed position, the duration that the displacement β is maintained is measured (in the steps S7 and S8).

If the duration that the displacement β is maintained is equal to or longer than $T_1$, the throttle opening is preset at a defined target low throttle opening, and the display lamp lights to indicate that the low-speed setting mode has been selected (steps S9 and S10). The opening/closing degree of the throttle valve 10 is controlled through the actuator 15 such that the throttle opening achieves the target low throttle opening. The target low throttle opening is so defined as to be slightly higher than the idling speed.

While the boat 1 cruises in the low-speed setting mode, if the acceleration fine adjustment switch 24 is pressed, a counter value is increased by one. If the counter value does not reach the maximum value, the throttle opening is increased by a constant degree, which is again defined as the target low throttle opening (steps S11 to S15).

While the boat 1 cruises in the low-speed setting mode, if the deceleration fine adjustment switch 25 is pressed, a counter value is decreased by one. If the counter value does not reach the minimum value, the throttle opening is decreased by a constant degree, which is again defined as the target low throttle opening (steps S16 to S19).

While the boat 1 cruises in the low-speed setting mode, if no acceleration/deceleration fine adjustment is made, and the displacement β of the acceleration lever 13 is not greater than the preset value $\beta_1$, under which the acceleration lever 13 is held almost at the fully closed position, and other conditions are satisfied, then the low-speed setting mode is maintained (steps S20 to S26).

The control system can also accommodate other scenarios. For example, the control system can determine that the acceleration lever 13 is almost at the fully closed position, the driving mode is not switched to the speed-limiting mode (step S21), a steering load is lower than a preset value $F_0$ (step S22), the engine operates normally (step S23), the forward/reverse drive shift lever is at the forward drive position (step S24), the engine is running (step S25), and the low-speed setting switch is not operated (step S26). If these conditions are satisfied, the boat continues to cruise in the low-speed setting mode.

The driver, desiring to clear the low-speed setting mode to switch to the normal operation mode, can perform any of the following operations: increasing the displacement β of the acceleration lever 13 greater than $\beta_1$ (step S20), increasing the displacement of the steering handlebar 3 (step S22), and pressing the low-speed setting switch 22 again (step S26). However, the control system can be configured to clear the low-speed setting mode and return to the normal operation mode using other events. The driver can perform any one of the above operations to automatically switch to the normal operation mode.

In the step S20, if the displacement of the acceleration lever 13 changes from a small amount $\beta_1$, under which the acceleration lever is almost at the fully closed position, to a large amount, the control unit 30 judges that the driver has cleared the low-speed setting mode. Then, the display lamp goes out. The preset target low throttle opening becomes invalid while the increasing/decreasing counter value is reset to zero (steps S27 to S29). This allows the speed-fixing mode to automatically switch to the normal operation mode.

In the step S22, if the steering load applied to the steering handlebar 3 by the driver's steering action is equal to or greater than the preset value $F_0$, or the steering angle of the steering handlebar 3 reaches a preset value, the control unit 30 can judge that the driver has cleared the low-speed setting mode so that the process flow goes to the step S27. The preset value $F_0$ is defined as a load applied to the steering handlebar 3 by the driver's steering action when the driver further steers the handlebar 3 abutted against a stopper. Such a stopper can have a force detection sensor, for example, but without limitation, any known load cell, pressure sensor, strain gauge, and the like.

In the step S26, if the driver presses the low-speed setting switch 22 again, and the duration that the low-speed setting switch 22 is kept ON is equal to or longer than a certain time period $T_2$, the control unit judges that the driver has cleared the low-speed setting mode so that the process flow goes to the step S27. The duration or time period $T_2$ is preset shorter than the time period $T_0$, which is one of the conditions to switch to the low-speed setting mode.

While the boat 1 cruises in the low-speed setting mode, the process will go to the step S27 to automatically clear the low-speed setting mode if any one of the conditions is detected: the speed-limiting mode is selected (step S21), the engine operates abnormally (step S23), the forward/reverse drive shift lever is shifted to the reverse drive position (step S24), and the engine is stopped (step S25).

According to some embodiments, if the displacement of the acceleration lever 13 is zero, or close to zero under which the acceleration lever 13 is almost or substantially at the fully closed position, the control unit 30 can permit the driving mode to switch to the low-speed setting mode. This allows the engine speed to decrease close to the idling speed at the time of switching to the low-speed setting mode. Thereby, a difference between the actual engine speed, detected at the time of switching to the low-speed setting mode, and the preset low engine speed can be reduced. This results in reduction in deceleration rate when the driving mode changes to the low-speed setting mode, thereby offering better ride comfort.

In some embodiments, if the forward/reverse drive shift lever is shifted to the reverse drive position, the control unit 30 prohibits the driving mode from switching to the low-speed setting mode. This can help the driver refrain from unnecessary operations. In other words, there is little need or opportunity to switch to the low-speed setting mode during reverse drive. This can eliminate the necessity to perform the operations described above.

In the case the low-speed setting mode has been selected, at the initial stage of the process for shifting the forward/reverse drive shift lever from the forward drive position to the reverse drive position, the control unit 30 clears the low-speed setting mode. Thus, the driver does not need to change the driving modes for shifting the shift lever, thereby improving ease of operation.

In some embodiments, the low-speed setting mode is cleared to automatically switch to the normal operation mode if any one of the following conditions are detected: the low-speed setting mode is selected, the displacement of the acceleration lever changes from a small to large amount under which the acceleration lever is almost at the fully opened position, the low-speed setting switch 22 is operated again, and the steering load, applied to the steering handlebar 3 by the driver's steering action, or the steering angle is equal to or greater than a preset value. Such simple operations enable switching from the low-speed setting mode to the normal operation mode. Also the driver can easily recognize that the driving mode has changed to the normal operation mode.

In some embodiments, if the engine fails to operate normally or each sensor fails to function normally, the control unit 30 prohibits the driving mode from switching to the low-speed setting mode. This helps the driver easily recognize that any anomaly occurs, thereby preventing problems with the engine that would continue to operate abnormally.

While the low-speed setting mode has been selected, if the engine fails to operate normally or each sensor fails to function normally, then the low-speed setting mode is cleared. This helps the driver easily recognize that any anomaly occurs, thereby preventing problems with the engine that would continue to operate abnormally.

In some embodiments, while the boat cruises in the low-speed setting mode, the acceleration/deceleration fine adjustment switches 24, 25 are operated to increase or decrease the cruising speed. This can offer the driver fine adjustments of the cruising speed to his/her desired speed.

In the aforementioned embodiments, the low-speed setting mode is achieved by controlling the throttle opening. However in other embodiments, the low-speed setting mode can also be achieved or triggered by controlling the engine speed or cruising speed.

Figure 6:
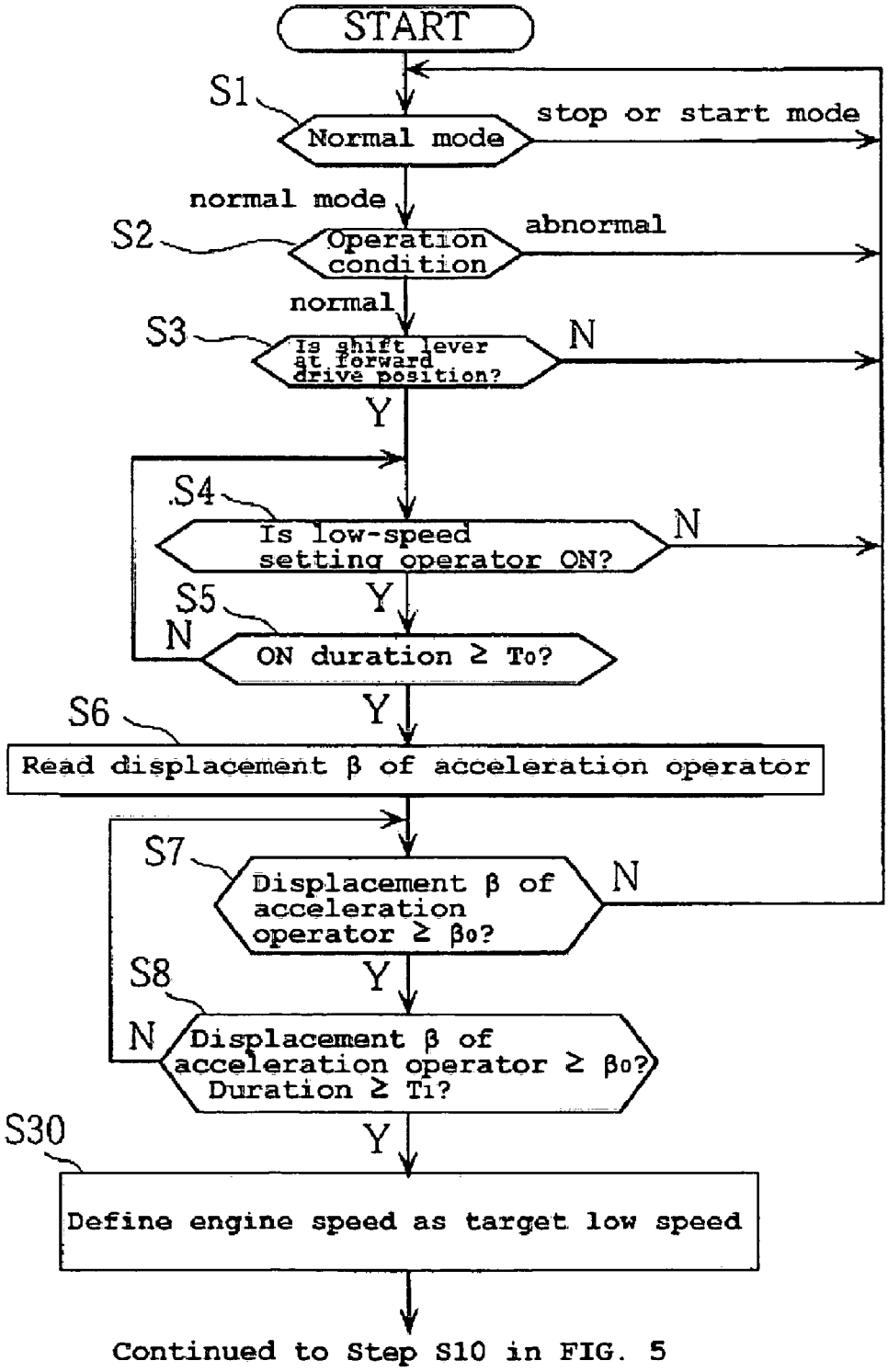
FIG. 6 is a flowchart of another control operation that can be used with the operation control system.

FIG. 6 is a flowchart of another program for controlling the engine speed to achieve the low-speed setting mode. In the figure, similar or equivalent parts are designated by the same numerals as in FIG. 4.

In the normal operation mode, if the engine operates normally, and the forward/reverse drive shift lever is at the forward drive position, then the low-speed setting switch 22 can be turned ON. If the low-speed setting switch is kept ON for a certain time period $T_0$ or longer, the control unit 30 judges that the driver has selected the low-speed setting mode, and reads the displacement β of the acceleration lever (steps S1 to S6). If the displacement β of the acceleration lever is equal to or lower than $\beta_0$ under which the acceleration lever is almost at the fully closed position, and is kept equal to or lower than $\beta_0$ for a preset time period $T_1$ or longer, then the engine speed is preset at a defined target low speed (step S30). The throttle opening is controlled such that the engine speed achieves the target low speed.

Figure 7:
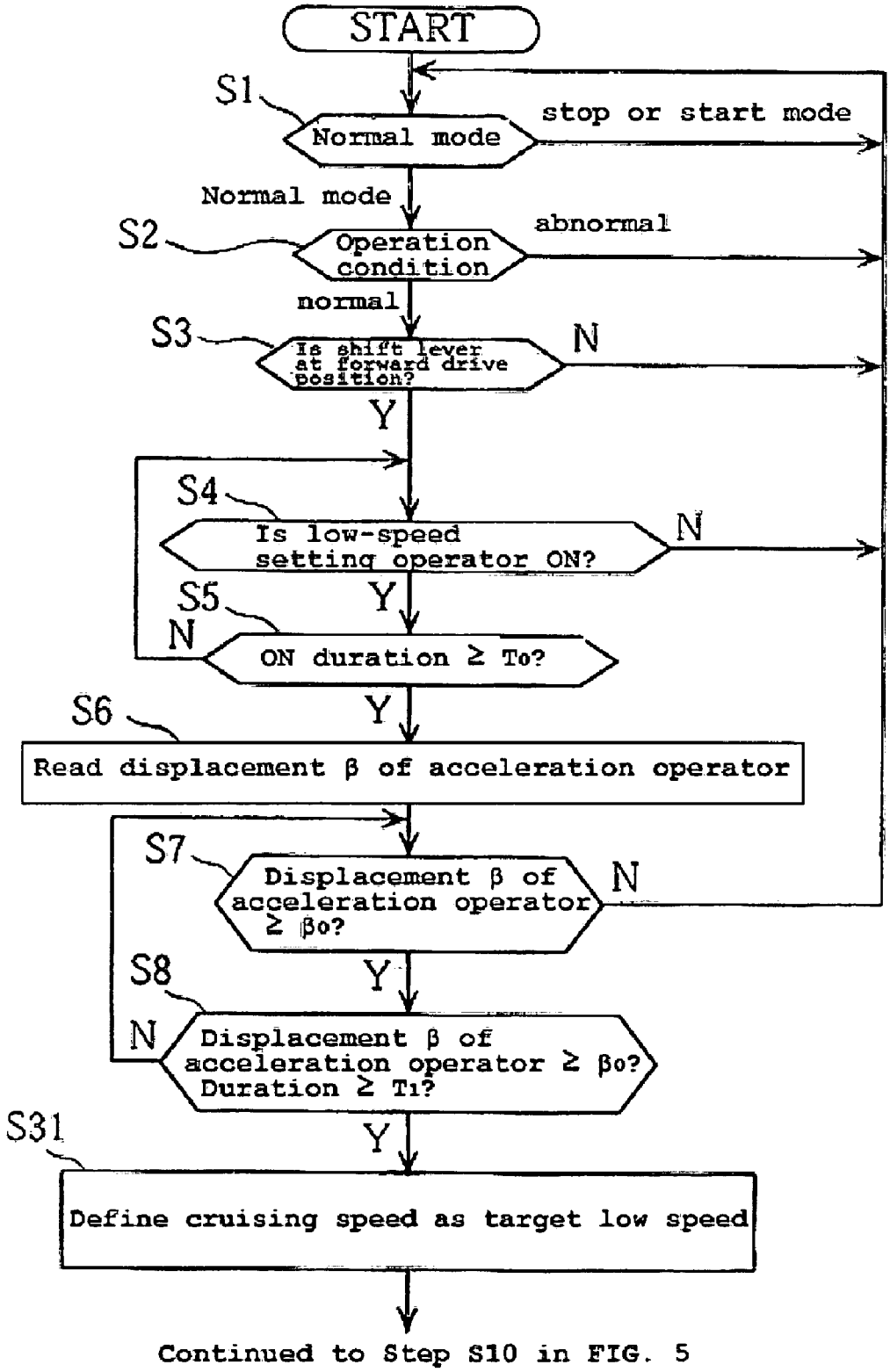
FIG. 7 is a flowchart of yet another control operation that can be used with the operation control system.

FIG. 7 is a flowchart of a program for controlling the cruising speed to achieve the speed-fixing mode. In the figure, similar or equivalent parts are designated by the same numerals as in FIG. 4.

In the normal operation mode, if the engine operates normally, and the forward/reverse drive shift lever is at the forward drive position, then the low-speed setting switch 22 can be turned ON. If the low-speed setting switch is kept ON for a certain time period $T_0$ or longer, the control unit judges that the driver has selected the low-speed setting mode, and reads the displacement β of the acceleration lever (steps S1 to S6). If the displacement β of the acceleration lever is equal to or lower than $\beta_0$ under which the acceleration lever is almost at the fully closed position, and is kept equal to or lower than $\beta_0$ for a preset time period $T_1$ or longer, then the cruising speed is preset at the defined target low speed (step S31). The throttle opening is controlled such that the cruising speed achieves the target low speed.

The low-speed setting mode is achieved by controlling the engine speed and the cruising speed in the manner as described, which also provides the same effects as those obtained in the aforementioned embodiment.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An operation control system for a small boat comprising acceleration displacement detecting means for detecting the displacement of an acceleration controller, and mode selection means for selecting a driving mode from a normal operation mode in which the boat cruises at a speed in response to the displacement of the acceleration controller detected by the acceleration displacement detecting means, and a low-speed setting mode in which the boat cruises at a preset low speed when a low-speed setting controller is operated, wherein the mode selection means permits the driving mode to switch to the low-speed setting mode if the displacement of the acceleration controller is zero, or small or close to zero, further comprising forward/reverse drive shift means for changing the direction of thrust generated by a propulsion unit to either forward or reverse direction, wherein the mode selection means permits the driving mode to switch to the low-speed setting mode if the forward/reverse drive shift means has been shifted to a forward drive position, and the mode selection means prohibits the driving mode from switching to the low-speed setting mode if the forward/reverse drive shift means has been shifted to a reverse drive position.

2. The operation control system for a small boat according to claim 1, wherein the mode selection means clears the low-speed setting mode if the low-speed setting mode has been selected before the initial stage of a whole process for shifting the forward/reverse drive shift lever from the forward to the reverse drive position.

3. The operation control system for a small boat according to claim 2 further comprising speed adjustment means for increasing or decreasing the cruising speed gradually in the case the low-speed setting mode has been selected.

4. The operation control system for a small boat according to claim 1 further comprising speed adjustment means for increasing or decreasing the cruising speed gradually in the case the low-speed setting mode has been selected.

5. An operation control system for a small boat comprising acceleration displacement detecting means for detecting the displacement of an acceleration controller, and mode selection means for selecting a driving mode from a normal operation mode in which the boat cruises at a speed in response to the displacement of the acceleration controller detected by the acceleration displacement detecting means, and a low-speed setting mode in which the boat cruises at a preset low speed when a low-speed setting controller is operated, wherein the mode selection means permits the driving mode to switch to the low-speed setting mode if the displacement of the acceleration controller is zero, or small or close to zero, wherein the mode selection means clears the low-speed setting mode to automatically switch to the normal operation mode if the low-speed setting mode has been selected, and if at least one of the small displacement of the acceleration controller changes to a large amount, the low-speed setting controller is operated again, and a steering load, applied to a steering device by the driver's steering action, or a steering angle is equal to or greater than a preset value.

6. An operation control system for a small boat comprising acceleration displacement detecting means for detecting the displacement of an acceleration controller, and mode selection means for selecting a driving mode from a normal operation mode in which the boat cruises at a speed in response to the displacement of the acceleration controller detected by the acceleration displacement detecting means, and a low-speed setting mode in which the boat cruises at a preset low speed when a low-speed setting controller is operated, wherein the mode selection means permits the driving mode to switch to the low-speed setting mode if the displacement of the acceleration controller is zero, or small or close to zero, further comprising anomaly detecting means for detecting an anomaly in at least any one of engine operation and all detecting means, wherein the mode selection means prohibits the driving mode from switching to the low-speed setting mode if any anomaly is detected.

7. The operation control system for a small boat according to claim 6, wherein the mode selection means clears the low-speed setting mode if low-speed setting mode has been selected and if any anomaly is detected in engine operation or each detecting means.

8. An operation control system for a small boat having an acceleration input device configured to allow a driver of the small boat to input an acceleration input, the system comprising an acceleration displacement detector configured to detect a displacement of an acceleration controller, and a mode selection module configured to allow a driver of the small boat to select between a plurality of driving modes, the driving modes including at least a normal operation mode in which the boat cruises at a speed in response to the displacement of the acceleration input device detected by the acceleration displacement detecting module, and a low-speed setting mode in which the boat cruises at a preset low speed when a low-speed setting controller is operated, wherein the mode selection module is configured to permit the driving mode to switch to the low-speed setting mode if the displacement of the acceleration input device is in or substantially at an idle speed position, further comprising a forward/reverse drive shift device configured to allow a driver of the small boat to change the direction of thrust generated by a propulsion unit of the small boat to either forward or reverse direction, wherein the mode selection module is configured to permit the driving mode to switch to the low-speed setting mode if the forward/reverse drive shift device has been shifted to a forward drive position, and wherein the mode selection module is configured to prohibit the driving mode from switching to the low-speed setting mode if the forward/reverse drive shift device has been shifted to a reverse drive position.

9. The operation control system for a small boat according to claim 8, wherein the mode selection module is configured to clear the low-speed setting mode if the low-speed setting mode has been selected before the initial stage of a whole process for shifting the forward/reverse drive shift device from the forward to the reverse drive position.

10. The operation control system for a small boat according to claim 9 further comprising a speed adjustment module configured to increase or decrease the cruising speed gradually in the case the low-speed setting mode has been selected.

11. The operation control system for a small boat according to claim 8 further comprising a speed adjustment module configured to increase or decrease the cruising speed gradually in the case the low-speed setting mode has been selected.

12. An operation control system for a small boat having an acceleration input device configured to allow a driver of the small boat to input an acceleration input, the system comprising an acceleration displacement detector configured to detect a displacement of an acceleration controller, and a mode selection module configured to allow a driver of the small boat to select between a plurality of driving modes, the driving modes including at least a normal operation mode in which the boat cruises at a speed in response to the displacement of the acceleration input device detected by the acceleration displacement detecting module, and a low-speed setting mode in which the boat cruises at a preset low speed when a low-speed setting controller is operated, wherein the mode selection module is configured to permit the driving mode to switch to the low-speed setting mode if the displacement of the acceleration input device is in or substantially at an idle speed position, wherein the mode selection module is configured to clear the low-speed setting mode to automatically switch to the normal operation mode if the low-speed setting mode has been selected, and if at least one of the small displacement of the acceleration input device changes to a large amount, the low-speed setting controller is operated again, and a steering load, applied to a steering device by the driver's steering action, or a steering angle is equal to or greater than a preset value.

13. An operation control system for a small boat having an acceleration input device configured to allow a driver of the small boat to input an acceleration input, the system comprising an acceleration displacement detector configured to detect a displacement of an acceleration controller, and a mode selection module configured to allow a driver of the small boat to select between a plurality of driving modes, the driving modes including at least a normal operation mode in which the boat cruises at a speed in response to the displacement of the acceleration input device detected by the acceleration displacement detecting module, and a low-speed setting mode in which the boat cruises at a preset low speed when a low-speed setting controller is operated, wherein the mode selection module is configured to permit the driving mode to switch to the low-speed setting mode if the displacement of the acceleration input device is in or substantially at an idle speed position, further comprising an anomaly detecting module configured to detect an anomaly in at least any one of engine operation and all detecting modules, wherein the mode selection module prohibits the driving mode from switching to the low-speed setting mode if any anomaly is detected.

14. The operation control system for a small boat according to claim 13, wherein the mode selection module is configured to clear the low-speed setting mode if low-speed setting mode has been selected and if any anomaly is detected in engine operation or each detecting modules.

* * * * *